US009695658B2

(12) United States Patent
Hallundbæk et al.

(10) Patent No.: US 9,695,658 B2
(45) Date of Patent: Jul. 4, 2017

(54) PULLING TOOL

(71) Applicant: WELLTEC A/S, Allerød (DK)

(72) Inventors: Jørgen Hallundbæk, Græstead (DK); Steffen Evertsen, Stavanger (NO); Rasmus Sommer, Valby (DK)

(73) Assignee: Welltec A/S, Allerød (DK)

( * ) Notice: Subject to any disclaimer, the term of this patent is extended or adjusted under 35 U.S.C. 154(b) by 452 days.

(21) Appl. No.: 14/358,761

(22) PCT Filed: Nov. 29, 2012

(86) PCT No.: PCT/EP2012/073915

§ 371 (c)(1),
(2) Date: May 16, 2014

(87) PCT Pub. No.: WO2013/079573

PCT Pub. Date: Jun. 6, 2013

(65) Prior Publication Data

US 2014/0311757 A1 Oct. 23, 2014

(30) Foreign Application Priority Data

Nov. 30, 2011 (EP) ..... 11191285

(51) Int. Cl.
*E21B 31/18* (2006.01)
*E21B 31/20* (2006.01)
(Continued)

(52) U.S. Cl.
CPC ..... *E21B 23/04* (2013.01); *E21B 31/12* (2013.01); *E21B 31/18* (2013.01); *E21B 31/20* (2013.01)

(58) Field of Classification Search
CPC ..... E21B 23/04; E21B 31/18; E21B 31/20
See application file for complete search history.

(56) References Cited

U.S. PATENT DOCUMENTS 5,242,201 A 9/1993 Beeman
5,377,749 A * 1/1995 Barbee ..... E21B 23/06 166/120

(Continued)

FOREIGN PATENT DOCUMENTS

CN 200946477 Y 9/2007
CN 201236651 Y 5/2009

(Continued)

OTHER PUBLICATIONS

International Preliminary Report on Patentability issued in corresponding International Application No. PCT/EP2012/073915 dated Jun. 3, 2014.

(Continued)

*Primary Examiner* — Cathleen Hutchins
(74) *Attorney, Agent, or Firm* — Nixon & Vanderhye P.C.

(57) ABSTRACT

A pulling tool for latching onto an object, such as a plug, downhole in a wellbore includes a base element extending in a longitudinal direction from a proximal end for being connected to a wireline tool to a distal end adapted to engage the object, and a latching mechanism encircling the base element and being movable in the longitudinal direction between a deactivated position and an activated position, having a piston sleeve, a key element for latching onto the downhole object, the key element being slidably received inside the piston sleeve and extending from an end of the piston sleeve towards the distal end of the base element, and a piston spring forcing the piston sleeve in the longitudinal direction towards the proximal end of the base element.

20 Claims, 5 Drawing Sheets

(51) Int. Cl.
*E21B 23/04* (2006.01)
*E21B 31/12* (2006.01)

(56) References Cited

U.S. PATENT DOCUMENTS

| | | | | |
|---|---|---|---|---|
| 5,775,433 | A | 7/1998 | Hammett et al. | |
| 6,095,583 | A * | 8/2000 | Beeman | E21B 31/18 294/86.15 |
| 2003/0217850 | A1 * | 11/2003 | Shaw | E21B 10/322 166/374 |
| 2012/0037358 | A1 * | 2/2012 | Ferkingstad | E21B 4/18 166/241.6 |

FOREIGN PATENT DOCUMENTS

| | | | | |
|---|---|---|---|---|
| GB | 2 231 359 | | 11/1990 | |
| GB | 2 295 410 | | 5/1996 | |
| NO | WO 2010123375 | A1 * | 10/2010 | E21B 4/18 |
| RU | 37519 | U1 | 4/2004 | |
| SU | 681182 | A1 | 8/1979 | |
| SU | 945364 | A1 | 7/1982 | |
| SU | 1002661 | A1 | 3/1983 | |

OTHER PUBLICATIONS

International Search Report for PCT/EP2012/073915, mailed Jan. 22, 2013.
Written Opinion of the ISA for PCT/EP2012/073915, mailed Jan. 22, 2013.
Decision to Grant dated Aug. 10, 2016 issued in Russian Application No. 2014124020/03 with English translation (18 pages).

* cited by examiner

PULLING TOOL

This application is the U.S. national phase of International Application No. PCT/EP2012/073915 filed 29 Nov. 2012 which designated the U.S. and claims priority to EP Patent Application No. 11191285.3 filed 30 Nov. 2011, the entire contents of each of which are hereby incorporated by reference.

FIELD OF THE INVENTION

The present invention relates to a pulling tool for latching onto an object, such as a plug, downhole in a wellbore. Furthermore, the present invention relates to a downhole retrieval system for pulling an object in a wellbore and to a method of connecting and disconnecting such retrieval system to a downhole object.

BACKGROUND ART

Known downhole pulling tools are often fully mechanical tools, wherein a mechanical locking mechanism is used to provide a rigid connection between the pulling tool and an object to be retrieved downhole, such as downhole plugs, tools, etc. The mechanical locking mechanism often comprises locking means, such as keys, dogs or fingers, extending from the body of the pulling tool to engage a recess, also denoted as a fishing neck, in the object to be retrieved. The locking means are usually locked in the fishing neck by applying a pulling force to the pulling tool, and subsequently the object may be pulled out of the well.

Tools or plugs set in a well often deploy some kind of anchoring mechanism which has to be released before they can be pulled out of the well. This anchoring mechanism may be disengaged by applying a pulling or pushing force to the tool or plug whereby a shear pin is broken. When the shear pin breaks, the anchoring mechanism is automatically retrieved or disengaged. However, in some cases the anchoring mechanism may get stuck, or it might not be possible to pull the tool or plug out of the well for other reasons. In those cases the pulling tool requires a fail-safe mechanism ensuring that the connection between the pulling tool and the object to be retrieved can be detached downhole. In known pulling tools, such fail-safe mechanisms are often constituted by a shear pin or other locking member. If the pulling tool gets stuck, the shear pin may be broken by jarring down on the GS pulling tool, i.e. by applying a pushing force to the pulling tool, whereby the mechanical locking mechanism is disengaged and the pulling tool can be detached from the tool in the well and retrieved to the surface. One of the disadvantages of the known pulling tools is that the tools are damaged or become inoperable following the activation of the fail-safe mechanism.

SUMMARY OF THE INVENTION

It is an object of the present invention to wholly or partly overcome the above disadvantages and drawbacks of the prior art. More specifically, it is an object to provide an improved pulling tool and a retrieval system having a reliable disengagement system.

The above objects, together with numerous other objects, advantages, and features, which will become evident from the below description, are accomplished by a solution in accordance with the present invention by a pulling tool for latching onto an object, such as a plug, downhole in a wellbore, comprising:

a base element extending in a longitudinal direction from a proximal end for being connected to a wireline tool to a distal end adapted to engage the object, and a latching mechanism encircling the base element and being movable in the longitudinal direction between a deactivated position and an activated position, comprising:

a piston sleeve, a key element for latching onto the downhole object, the key element being slidably received inside the piston sleeve and extending from an end of the piston sleeve towards the distal end of the base element, and a piston spring forcing the piston sleeve in the longitudinal direction towards the proximal end of the base element, wherein the latching mechanism is adapted to latch onto the downhole object when being activated by supplying a hydraulic fluid via a fluid channel extending from the proximal end of the base element to an expandable piston chamber which is at least partly defined by the piston sleeve, whereby the latching mechanism is displaceable from the deactivated position to the activated position, and the latching mechanism is adapted to be disengaged from the downhole object when the supply of hydraulic fluid is terminated, whereby the latching mechanism is displaceable from the activated position to the deactivated position by the piston spring.

The pulling tool being activated by the supply of hydraulic fluid causes the pulling tool to be conversely deactivated when the supply of hydraulic fluid is terminated. The pulling tool thus has a passive fail-safe system, meaning that the pulling tool can always be disengaged when in a deactivated or passive state and the pulling tool has to be activated to be operable. If, for example, the hydraulic system breaks down, the pulling tool can always be disengaged.

In one embodiment, the key element may comprise a plurality of arms flexible in a radial direction, the arms having protrusions at a distal end for engaging a recess of the downhole object.

Moreover, the base element may be adapted to allow an inwards flexion of the arms when the latching mechanism is in the deactivated position.

A section of the base element, adjacent the distal end of the arms when the latching mechanism is in the deactivated position, may have a reduced diameter so that the plurality of arms are inwardly flexible when the latching mechanism is in the deactivated position.

Further, the latching mechanism may be activated by supplying a hydraulic fluid to the expandable piston chamber at a flow rate of 0.1-1.0 liters/minute, preferably 0.2-0.4 liters/minute.

The pulling tool may thus be activated using a very low volumetric flow of hydraulic fluid compared to known pulling tools, such as coiled tubing pulling tools requiring a flow rate of approximately 160 liters/minute.

Also, the key element may be slidable in the longitudinal direction towards the proximal end of the base element when the latching mechanism is in the activated position, and the base element may be adapted to allow an inwards flexion of the arms when the key element is displaced towards the proximal end of the base element.

In another embodiment, the key element may be slidable in the longitudinal direction towards the proximal end of the base element when the latching mechanism is in the activated position so that the arms can be displaced towards the proximal end of the base element and bend inwards due to the reduced diameter of a section of the base element.

Furthermore, the base element may comprise a protruding flange adjacent the distal end for underpinning the plurality of arms of the key element when the latching mechanism is in the activated position, the flange preventing direct inwards radial movement.

Additionally, the base element may comprise a protrusion adjacent the distal end, thereby restricting longitudinal movement of the key element beyond the protrusion.

The arms of the key element may be restricted from bending inwards by the flange and restricted from moving in the longitudinal direction by the protrusion of the base element in one direction and by the protrusions on the arms of the key element being trapped in the recess of the downhole object in the other direction. Hereby, the connection between the pulling tool and the downhole object is mechanically locked when a pulling force is applied to the pulling tool. When the downhole object is being pulled out of the well, it is thus not necessary to continuously supply hydraulic fluid to the pulling tool to maintain the connection between the pulling tool and the downhole object, provided that a constant pulling force is applied to the pulling tool.

The piston spring may thus force the piston sleeve in a direction opposite the direction in which the hydraulic fluid forces the piston sleeve, thereby providing a fail-safe system ensuring that the latching mechanism is forced into the deactivated position if the hydraulic pressure is lost and tension on the pulling tool is removed.

Further, the piston spring may abut the piston sleeve and the base element, thereby displacing the piston sleeve in relation to the base element.

Also, the piston chamber may be defined by the base element and the piston sleeve.

The latching mechanism may further comprise a key spring forcing the key element in the longitudinal direction towards the proximal end of the base element.

In addition, the key spring may abut the piston sleeve and a proximal end of the key element, thereby forcing the key element in the longitudinal direction towards the distal end of the base element.

Moreover, the base element may comprise an upper base element and a lower base element that are threadedly connected.

The present invention further relates to a downhole retrieval system for pulling an object in a wellbore, comprising:

- a pulling tool for latching onto an object downhole, such as a plug, and
- a hydraulic system for supplying hydraulic fluid to the pulling tool, wherein the pulling tool is a pulling tool as described above.

Such retrieval system may further comprise a motor for driving the hydraulic system, a compensator unit for supplying a fluid to the retrieval system to provide an excess pressure inside the retrieval system compared to the surroundings, and an electronic section for powering and controlling the retrieval system.

The downhole retrieval system as described above may further comprise:

- a stroker tool for providing a force in an axial direction, comprising:
  - a hydraulic system driven by a motor,
  - a stroker cylinder, and
  - a hydraulic piston rod driven by the hydraulic system and movable in the axial direction in the stroker cylinder, the piston rod being connected with the pulling tool and the first mentioned hydraulic system.

Furthermore, the downhole retrieval system as described above may comprise:

- a stroker cylinder, and
- a hydraulic piston rod movable in the axial direction in the stroker cylinder, wherein the pulling tool is mounted on the piston rod and the hydraulic system supplies hydraulic fluid to both the pulling tool and the stroker cylinder to drive the hydraulic piston rod in the axial direction and to the pulling tool.

By using a common hydraulic system and mounting the pulling tool on the piston rod, the total length of the retrieval system may be reduced as compared to systems using separate hydraulic systems for the stroker cylinder and the pulling tool. This is advantageous as length of the tool string, i.e. the total length of the retrieval system and the object to be retrieved, is often a limiting factor. The total length of the tool sting is limited by the blowout preventer (BOP) as the length of the tool string cannot exceed the length between the safety valves of the BOP.

The downhole retrieval system as described above may further comprise a driving unit for driving the entire retrieval system forward in inclining sections of a wellbore.

Finally, the present invention relates to a method of connecting and disconnecting the retrieval system as described above to a downhole object, comprising the steps of:

- activating the pulling tool by supplying a hydraulic fluid to the pulling tool whereby the latching mechanism is moved in the longitudinal direction,
- latching the pulling tool onto the object,
- providing a pulling force in the pulling tool,
- terminating the supply of hydraulic fluid to the pulling tool, and
- disengaging the pulling tool from the object.

In said method, the step of latching the pulling tool onto the object may comprise the steps of:

- inserting the distal end of the pulling tool into the downhole object until the key element abuts the downhole object,
- forcing the pulling tool further towards the downhole object, whereby the key element is forced towards the proximal end of the base element, thereby compressing the key spring, and the arms enter a position allowing inwards flexion, and
- moving the pulling tool still further into the downhole object whereby the projections on the arms of the key element pass a fishing neck of the downhole object and enter the recess of the downhole object.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
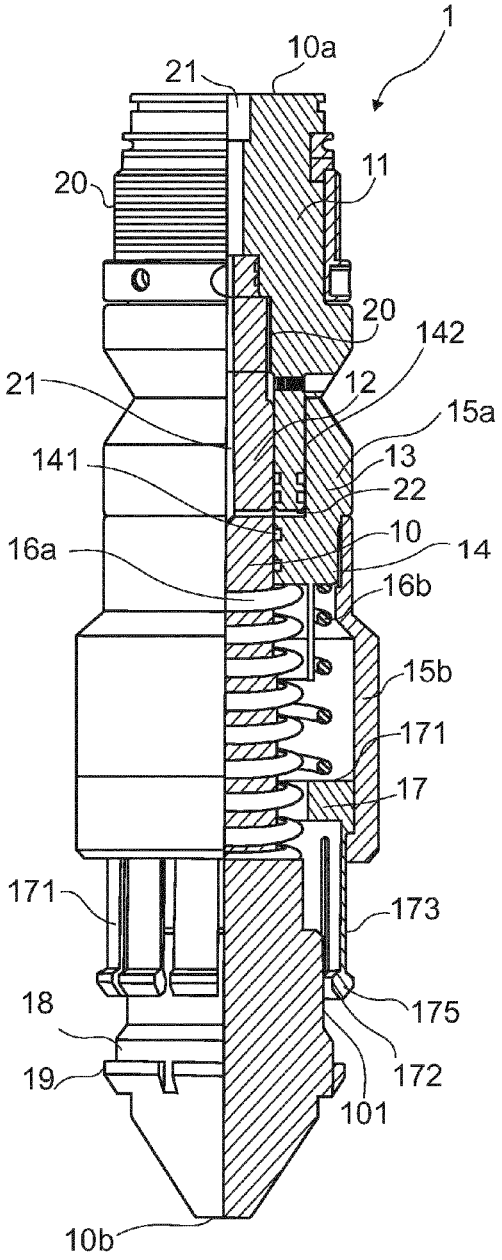
FIG. 1*a* shows a pulling tool in the deactivated state.
Figure 1B:
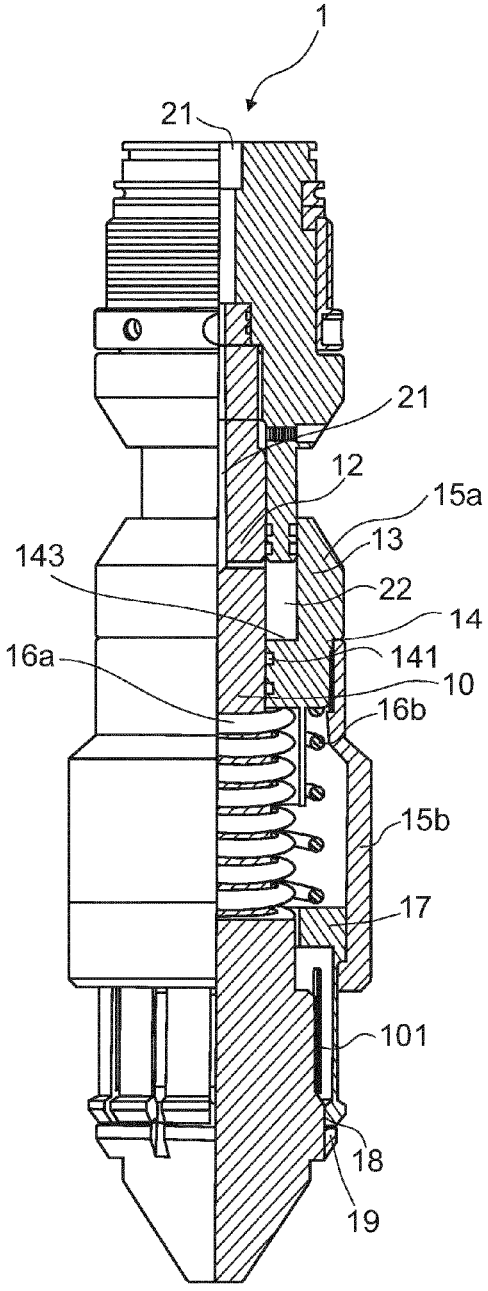
FIG. 1*b* shows a pulling tool in the activated state.

FIGS. 1*a* and 1*b* show a pulling tool 1 in a deactivated state and an activated state, respectively. The pulling tool 1 comprises a base element 10 extending in a longitudinal direction from a proximal end 10*a* for being connected to a wireline tool, to a distal end 10*b* adapted to engage a downhole object. The proximal end of the pulling tool 1 may alternatively be connected to a coiled tubing tool, coiled tubing or a drill string for insertion in the well. The pulling tool 1 further comprises a latching mechanism 13 encircling the base element 10 and being movable in the longitudinal direction between a deactivated position as shown in FIG. 1*a* and an activated position as shown in FIG. 1*b*.

The latching mechanism 13 comprises a piston sleeve 14 slidably received around the base element 10. The piston sleeve 14 thus constitutes an exterior annular piston movable in the longitudinal direction along the base element 10. The latching mechanism further comprises a key element 17 for latching onto a downhole object. The key element 17 extends from an end of the piston sleeve 14 towards the distal end 10*b* of the base element 10. Further, the key element 17 is slidably received inside part of the piston sleeve 14 and is slidable in relation to the base element 10.

In one embodiment, the base element 10 may comprise an upper base element 11 and a lower base element 12 that are threadedly connected via a thread 20.

Also, in one embodiment, the piston sleeve 14 comprises a piston part 15*a* and a sleeve part 15*b* which are rigidly connected. The piston part 15*a* slidably abuts the base element 10 and sealing elements 141 provide a fluid-tight seal between the piston part 15*a* and the base element 10. Further, the piston part 15*a* has a bore 142 of increased diameter and the piston part 15*a* thus encircles a section of the base element 10 having a corresponding outer increased diameter. Hereby, the base element 10 and the piston part 15*a* define an expandable piston chamber 22 to which hydraulic fluid is supplied via a fluid channel 21 extending from the proximal end 10*a* of the base element 10. Hydraulic fluid supplied to the piston chamber 22 exerts a force on a face 143 of the piston part 15*a*, whereby the piston part, and thus the piston sleeve 14, is displaced in the longitudinal direction in relation to the base element 10 until the latching mechanism is in the activated position, as shown in FIG. 1*b*. Further, the piston chamber 22 is expanded from the initial volume shown in FIG. 1*a* to the volume shown in FIG. 1*b*. The sleeve part 15*b* of the piston sleeve 14 extends from the piston part 15*a* towards distal end 10*b* of the base element 10, thereby providing a housing for a piston spring 16*a* and a key spring 16*b* of the latching mechanism, as will be described further in the following.

The piston spring 16*a* is arranged around the base element 10, and one end of the piston spring 16*a* abuts on the base element and the opposite end on the piston part 15*a*. Hereby, the piston spring 16*a* forces the piston sleeve in the longitudinal direction towards the proximal end 10*a* of the base element. By having a piston spring 16*a* forcing the piston sleeve in a direction opposite the direction in which the hydraulic fluid forces the piston sleeve, a fail-safe system is provided ensuring that the latching mechanism is forced into the deactivated position if the hydraulic pressure is lost and tension on the pulling tool 1 is removed. The fail-safe system will be further described below.

Figure 2A:
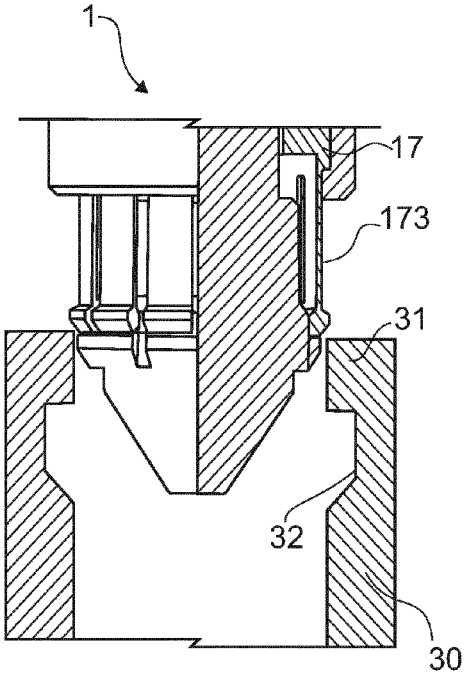
FIGS. 2*a* and 2*b* show a pulling tool engaging a recess in a downhole object.
Figure 2B:
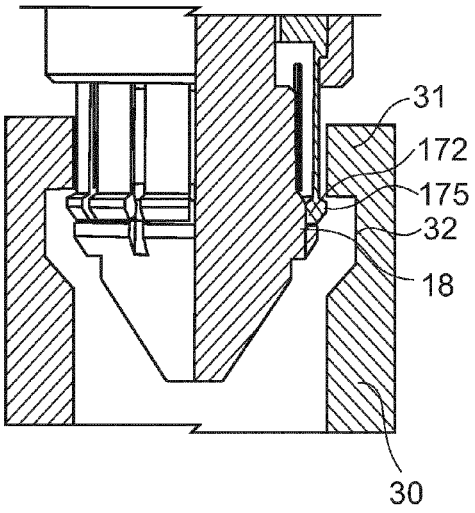

The key spring 16*b* abuts on a face of the piston part 15*a* and on a proximal end of the key element 17, thereby forcing the key element 17 away from the piston part. In one embodiment, the key element comprises a plurality of arms 173 flexible in a radial direction. The arms 173 extend in a longitudinal direction of the key element 17 and are adapted to bend inwards towards the base element 10. The arms comprise protrusions 175 at a distal end 172 for engaging a recess 32 of an object 30 downhole, as illustrated in FIGS. 2*a* and 2*b* and described in further detail below.

The base element 10 is constructed so that the arms 173 may bend or flex inwards when the latching mechanism is in the deactivated position. A section 101 of the base element has a reduced diameter so that the plurality of arms are inwardly flexible when the latching mechanism is in the deactivated position. The section of reduced diameter 101 terminates towards the distal end of the base element in a protruding flange 18 having a diameter which is substantially equal to an inner diameter of the key element 17. When the latching mechanism 13 is in the activated position, the distal end of the key element 17 encircles the protruding flange 18, and the arms 173 will thus by default be underpinned by or rest on the flange 18. Hereby, the arms 171 are restricted from directly bending inwards and are thus locked in the radial direction. However, if the key element and thus the arms 173 are forced in the longitudinal direction towards the piston part 15*a*, i.e. backwards in relation to the base element, thereby compressing the key spring 16*b*, the arms will eventually enter a position allowing inwards flexion. As soon as the arms 173 are clear of the protruding flange 18, inwards flexion is no longer restricted, and the arms 173 may bend when subject to an outer compressing force. In use, this will typically happen when the pulling tool 1 is in the process of latching onto a downhole object, as shown in FIGS. 2*a* and 2*b*. The key element 17 abuts the fishing neck 31 of the downhole object, and when moving the pulling tool further towards the downhole object, the key element 17 is forced towards the proximal end of the base element, whereby the arms enter a position allowing inwards flexion. Hereby, the protrusions 175 on the distal end of the arms 173 are capable of passing the fishing neck 31 of the object and be arranged inside the downhole object as shown in FIG. 2*b*.

At a distal end of the flange 18, the base element 10 comprises a protrusion 19 providing a stop restricting longitudinal movement of the key element 17 beyond a certain position. When the pulling tool 1 is connected with a downhole object and a pulling force is applied, the arms 173 of the key element 17 are thus restricted from bending inwards by the flange 18 and restricted from moving in the longitudinal direction by the protrusion 19 in one direction and by the weight of the object acting in the other direction on the protrusions 175 of the arms 173. Hereby, the connection between the pulling tool 1 and the object is mechanically locked.

Figure 3:
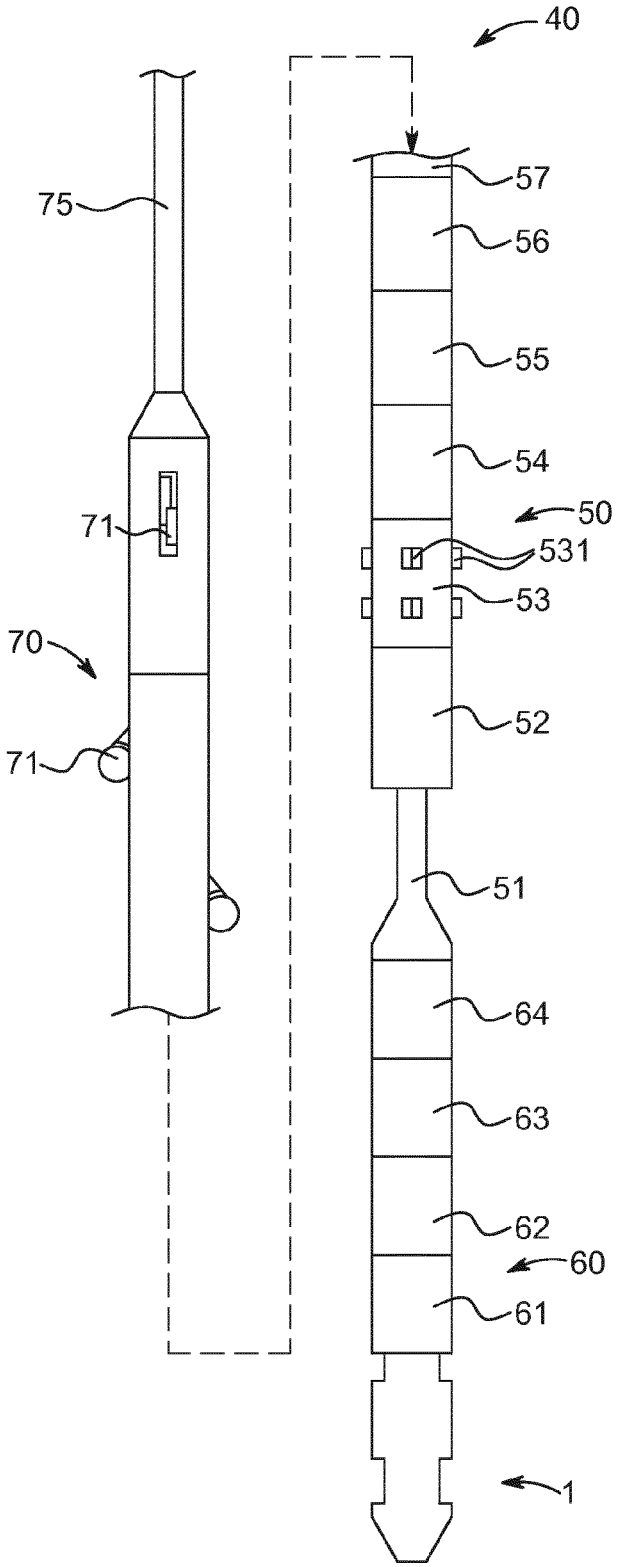
FIG. 3 shows a retrieval system.

In use, the pulling tool 1 is part of a downhole retrieval system 40 for pulling an object in a wellbore as shown in FIG. 3. The retrieval system shown in FIG. 3 comprises a pulling tool section 60, a stroker tool 50 and a driving unit 70, such as a downhole tractor. The pulling tool section 60 comprises a hydraulic system 61 for supplying hydraulic fluid to the pulling tool 1, a motor 62 driving a pump of the hydraulic system, a compensator unit 63 for supplying a fluid to the tool section to provide an excess pressure inside the tool section compared to the surroundings, and an electronic section 64 for providing power and control functions. The pulling tool section 60 is connected to a hydraulic piston rod 51 of the stroker tool 50 providing a force or stroke in an axial direction. The hydraulic piston rod 51 extends from a stroker cylinder 52 and is driven by a hydraulic system 54. The stroker tool 50 further comprises a motor 55 driving the hydraulic system, an anchor section 53 for anchoring the stroker tool and the retrieval system in the wellbore, and an electronic section 56 and a compensator 57 similar to that of the pulling tool section 60. If the retrieval system 40 is deployed in an inclining wellbore 80, the retrieval system may comprise a driving unit 70 for driving the entire retrieval system forward in inclining sections of a wellbore 80. The driving unit may be of the downhole tractor type providing a forward motion by means of multiple driving wheels 71 extending towards the side of the wellbore 80. The wheels may be driven by a hydraulic system and provide the necessary traction to secure the propulsion of the retrieval system downhole. As an alternative to the force generated by the stroker tool 50, the driving unit 70 may be used for applying a pulling force to the pulling tool 1. The driving unit 70 may also be used in combination with the stroker tool 50 for providing the necessary pulling force.

Figure 4:
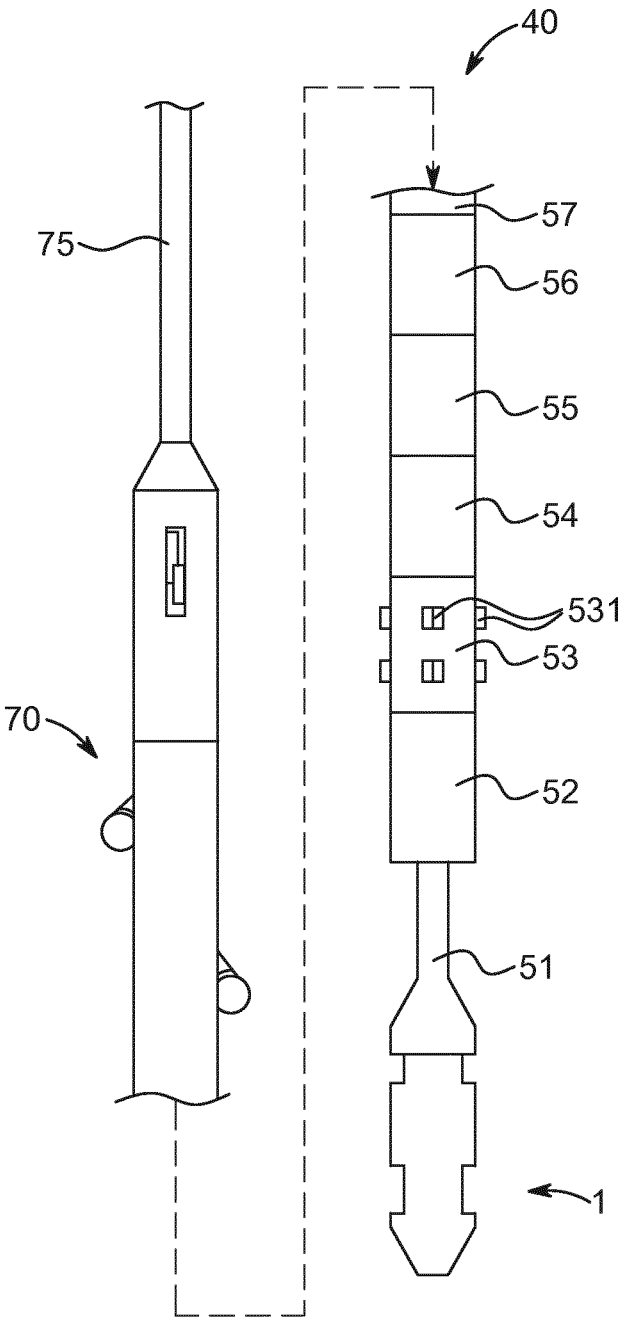
FIG. 4 shows another retrieval system.

FIG. 4 shows another embodiment of a retrieval system wherein the pulling tool 1 is mounted on the hydraulic piston rod 51 movable in the axial direction in the stroker cylinder 52. In this embodiment, the hydraulic system 54 supplies hydraulic fluid to both the pulling tool 1 to provide the necessary activation of the latching mechanism 13 and to the stroker cylinder to drive the hydraulic piston rod 51 in the axial direction. Otherwise, the stroker tool 50 is substantially similar to the stroker tool described above in connection with the previous embodiment.

Figure 5:
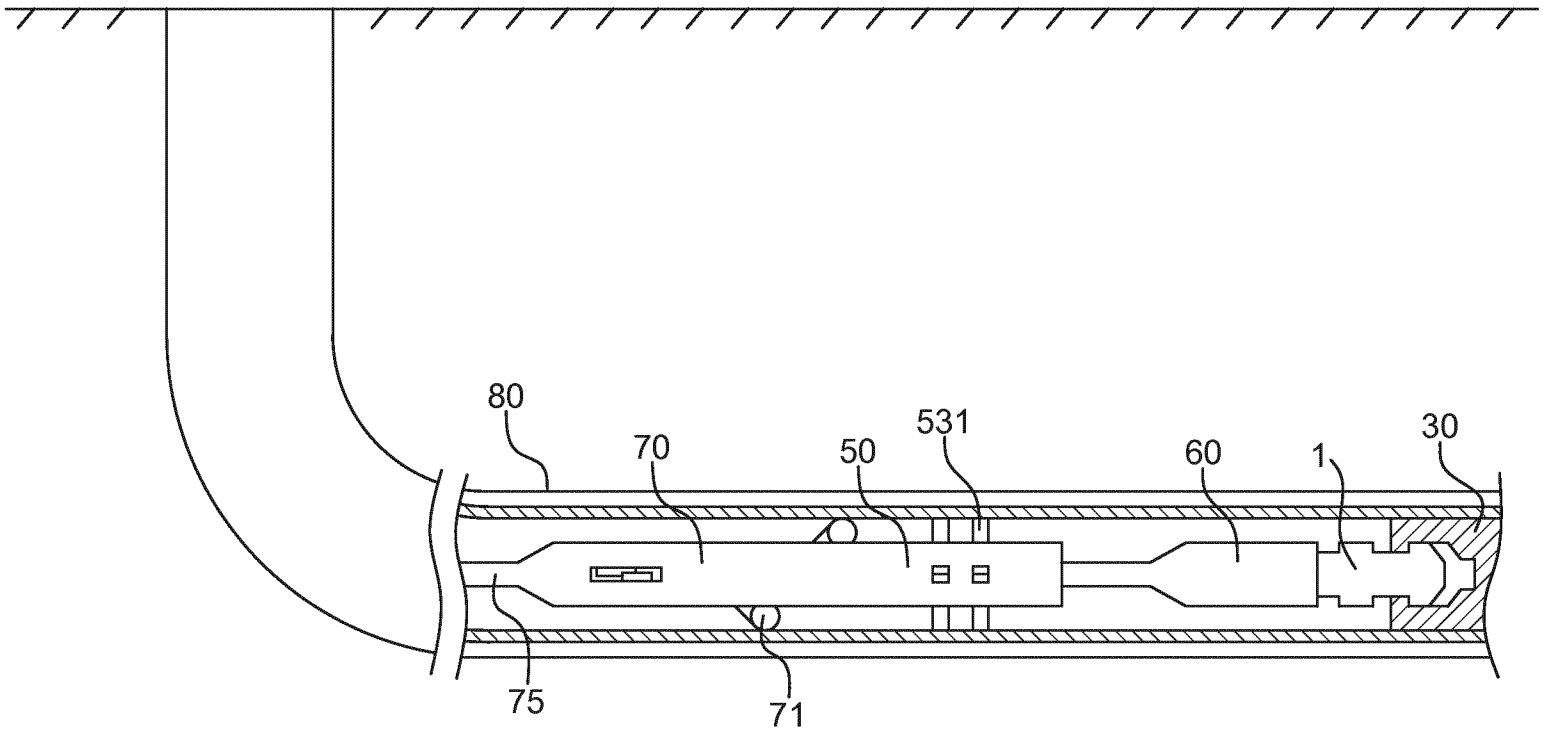
FIG. 5 shows a wellbore with a retrieval system deployed downhole.

FIG. 5 shows the downhole retrieval system 40 suspended in a wellbore 80 on a wireline 75. In use, the retrieval system may be assembled at the surface of the well and the necessary units and tool section may be included in the tool string according to specific needs. In order to pull a downhole object, the retrieval system is inserted into the wellbore 80 and moved to the desired location downhole.

Before engaging an object 30, such as a downhole plug, tool, etc., hydraulic fluid under pressure is supplied to the pulling tool whereby the pulling tool is activated and the latching mechanism 13 moves into the activated position as shown in FIG. 1*b*. Subsequently, the pulling tool is latched onto the object by moving the pulling tool into engagement with the object, e.g. into engagement with a fishing neck 31 of the object as shown in FIGS. 2*a* and 2*b*. When the pulling tool moves into engagement with the object, the arms 171 of the key element 17 are forced backwards by the object until they bend inwards into the section 101 of the base element 10 of the pulling tool having a reduced diameter. Hereby, a front end of the pulling tool enters the object. When the distal end 172 of the key element reaches a recess 32 in the object, the arms 171 of the key element 17 bend outwards and slide onto the protruding flange 18 due to the force of the key spring 16*b* shown in FIG. 1*b*. Hereby, the protrusions 175 of the arms 171 engage a recess 32 in the objet and the arms 171 rest on the protrusion 18 of the base element 10 as shown in FIG. 2*b*. Subsequently a pulling force may be provided to pull the object.

The pulling force may be applied using the stroker tool 50, the driving unit 70 or a combination of the two. For the stroker tool 50 to provide a pulling force, the anchor section 53 is activated whereby a plurality of anchors 531 engage the side of the wellbore 80 in order to restrict movement of the retrieval system 40 in the wellbore 80, as shown in FIG. 5.

When a pulling force is applied to the pulling tool, the connection between the pulling tool and the object is mechanically locked by the mutual interaction of the flange 18 and the protrusion 19 of the base element 10 and the protrusions 175 on the arms 173, as described above. This mechanical locking arrangement is not dependent on the constant supply of hydraulic fluid and the hydraulic pressure in the pulling tool. The supply of hydraulic fluid to the pulling tool is thus not necessary when the object to be pulled is being pulled out of the well, provided that a constant pulling force is applied to the pulling tool. Consequently, the supply of hydraulic fluid may be stopped when the a pulling force is applied to the retrieval system. Similarly, if the hydraulic systems fails unintentionally, the connection between the pulling tool and the object to be pulled is not disengaged.

If the object for some reason cannot be pulled or gets stuck during retrieval from the well, the connection may be disengaged. To disengage the pulling tool, the supply of hydraulic fluid to the expandable piston chamber 22 is terminated, whereby the hydraulic pressure on the piston part 15*a* decreases. The piston spring 16*a* will thus try to force the piston sleeve 14 and the key element 17 in the opposite direction towards the proximal end 10*a* of the base element 10. As the key element 17 is mechanically locked in the stuck object, the base element 10 will move further into the stuck object 30, provided that the tension on the pulling tool is released. When the arms 173 of the key element are in a position allowing inwards flexion, the pulling tool may be removed from the stuck object as the arms 173 bend inwards to disengage the connection between the pulling tool 1 and the object 30. Subsequently, the pulling tool and the retrieval system may be removed from the well.

The functionality described above entails a fail-safe system or mechanism wherein the pulling tool can always be disengaged from the object to be pulled downhole. If, for example, the hydraulic systems fail or communication between the retrieval system and an operator at the surface is lost, it will always be possible to disengage the pulling tool.

To avoid unintentional interruption in the supply of hydraulic fluid, the retrieval system may comprise an accumulator or battery for powering the hydraulic system 54, 61 in case of power failure. However, such system may also entail that the supply of hydraulic fluid to the pulling tool is unintentionally continued, for example if communication with the retrieval system is lost and the hydraulic systems cannot be manually controlled. Consequently, the retrieval system may comprise a timer set to stop the supply of hydraulic fluid after a predetermined period of time. To prevent the timer from unintentionally stopping the supply of hydraulic fluid after a power failure, the retrieval system may also comprise means for detecting changes in the current in the wireline. If no current is detected, the accumulator or battery is turned on and turned off again when the power returns. Further, the detection means may provide a reset signal to the timer when detecting current in the wireline whereby the timer is reset.

In one embodiment, the timer is an electrical timer, but it may equally well be a mechanical timer. The detection means is a non-contact means such as a pick-up, a coil, a capacitor, a hall element or the like. In another embodiment, the detection means may be a voltmeter or the like being in contact with the current in the wireline or any other wires in the downhole system.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A pulling tool for latching onto an object, downhole in a wellbore, the pulling tool comprising:

a base element extending in a longitudinal direction from a proximal end for being connected to a wireline tool to a distal end adapted to engage the object, and a latching mechanism encircling the base element and being movable in the longitudinal direction between a deactivated position and an activated position, the latching mechanism comprising:

a piston sleeve, a key element for latching onto the downhole object, the key element being slidably received inside the piston sleeve and extending from an end of the piston sleeve towards the distal end of the base element, and a piston spring forcing the piston sleeve in the longitudinal direction towards the proximal end of the base element, wherein the latching mechanism is adapted to latch onto the downhole object when being activated by supplying a hydraulic fluid via a fluid channel extending from the proximal end of the base element to an expandable piston chamber which is at least partly defined by the piston sleeve, whereby the piston sleeve is slidable in the longitudinal direction towards the distal end of the base element as the latching mechanism is brought from the deactivated position to the activated position, and the latching mechanism is adapted to be disengaged from the downhole object when the supply of hydraulic fluid is terminated, whereby the latching mechanism is brought from the activated position to the deactivated position by the piston spring forcing the piston sleeve in the longitudinal direction towards the proximal end of the base element.

2. A pulling tool according to claim 1, wherein the key element comprises a plurality of arms flexible in a radial direction, the arms having protrusions at a distal end for engaging a recess of the downhole object.

3. A pulling tool according to claim 2, wherein the base element is adapted to allow an inwards flexion of the arms when the latching mechanism is in the deactivated position.

4. A pulling tool according to claim 3, wherein the key element is slidable in the longitudinal direction towards the proximal end of the base element as the latching mechanism is moved towards the deactivated position, and the base element is adapted to allow an inwards flexion of the arms when the key element is displaced towards the proximal end of the base element.

5. A pulling tool according to claim 1, wherein the base element comprises a protruding flange adjacent the distal end for underpinning the plurality of arms of the key element when the latching mechanism is in the activated position, the flange preventing direct inwards radial movement.

6. A pulling tool according to claim 1, wherein the base element further comprises a protrusion adjacent the distal end, thereby restricting longitudinal movement of the key element beyond the protrusion.

7. A pulling tool according to claim 1, wherein the latching mechanism further comprises a key spring forcing the key element in the longitudinal direction towards the distal end of the base element.

8. A downhole retrieval system for pulling an object in a wellbore, comprising:

a pulling tool for latching onto an object downhole, and a hydraulic system for supplying hydraulic fluid to the pulling tool, wherein the pulling tool is a pulling tool according to claim 1.

9. A downhole retrieval system according to claim 8, further comprising:

a stroker tool for providing a force in an axial direction, comprising:

a hydraulic system driven by a motor, a stroker cylinder, and a hydraulic piston rod driven by the hydraulic system and movable in the axial direction in the stroker cylinder, the piston rod being connected with the pulling tool and the first mentioned hydraulic system.

10. A downhole retrieval system according to claim 8, further comprising:

a stroker cylinder, and a hydraulic piston rod movable in the axial direction in the stroker cylinder, wherein the pulling tool is mounted on the piston rod and the hydraulic system supplies hydraulic fluid to both the pulling tool and the stroker cylinder to drive the hydraulic piston rod in the axial direction and to the pulling tool.

11. A downhole retrieval system according to claim 8, further comprising a driving unit for driving the entire retrieval system forward in inclining sections of a wellbore.

12. A method of connecting and disconnecting the retrieval system according to claim 8 to a downhole object, comprising:

activating the pulling tool by supplying a hydraulic fluid to the pulling tool whereby the latching mechanism is moved in the longitudinal direction, latching the pulling tool onto the object, providing a pulling force in the pulling tool, terminating the supply of hydraulic fluid to the pulling tool, and disengaging the pulling tool from the object.

13. A method according to claim 12, wherein the latching the pulling tool onto the object comprises:

inserting the distal end of the pulling tool into the downhole object until the key element abuts the downhole object, forcing the pulling tool further towards the downhole object, whereby the key element is forced towards the proximal end of the base element, thereby compressing the key spring, and the arms enter a position allowing inwards flexion, and moving the pulling tool still further into the downhole object whereby the projections on the arms of the key element pass a fishing neck of the downhole object and enter the recess of the downhole object.

14. A pulling tool according to claim 1, wherein the key element is slidable in the longitudinal direction towards the distal end of the base element as the latching mechanism is moved towards the activated position and the hydraulic fluid is supplied to the piston chamber.

15. A pulling tool according to claim 1, wherein the key element is slidable either towards the distal end or towards the proximal end when in the activated position or the deactivated position.

16. A pulling tool according to claim 1, wherein the proximal and distal ends of the base element are fixed relative to one another in the same position in both the activated and deactivated positions.

17. A pulling tool according to claim 1, wherein the key element is detachable from the downhole object when the supply of hydraulic fluid is terminated and the latching mechanism is in the deactivated position.

18. A pulling tool according to claim 1, wherein to disconnect the pulling tool from the downhole object, the supply of hydraulic fluid to the piston chamber is terminated, at which time the piston spring will force the piston sleeve and the key element towards the proximal end.

19. A pulling tool according to claim 1, wherein the base element is movable further into the downhole object, when the tension on the pulling tool is released, to thereby allow the key element to radially move inward relative to the base element, whereby the key element and thus the pulling tool may be disconnected from the downhole object by pulling the pulling tool in an uphole direction.

20. A pulling tool for latching onto an object, downhole in a wellbore, the pulling tool comprising:

a base element extending in a longitudinal direction from a proximal end for being connected to a wireline tool to a distal end adapted to engage the object, and a latching mechanism encircling the base element and being movable in the longitudinal direction between a deactivated position and an activated position, the latching mechanism comprising:

a piston sleeve, a key element for latching onto the downhole object, the key element being slidably received inside the piston sleeve and extending from an end of the piston sleeve towards the distal end of the base element, and a piston spring forcing the piston sleeve in the longitudinal direction towards the proximal end of the base element, wherein the latching mechanism is adapted to latch onto the downhole object when being activated by supplying a hydraulic fluid via a fluid channel extending from the proximal end of the base element to an expandable piston chamber which is at least partly defined by the piston sleeve, whereby the latching mechanism is displaceable from the deactivated position to the activated position, and the latching mechanism is adapted to be disengaged from the downhole object when the supply of hydraulic fluid is terminated, whereby the latching mechanism is displaceable from the activated position to the deactivated position by the piston spring; and wherein to disconnect the pulling tool from the downhole object, the supply of hydraulic fluid to the piston chamber is terminated, at which time the piston spring will force the piston sleeve and the key element towards the proximal end.

* * * * *